US006018830A

United States Patent [19]

Howe

[11] Patent Number: 6,018,830

[45] Date of Patent: Feb. 1, 2000

[54] ADJUSTABLE SLEEPING BAG WITH DRAWCORDS

[76] Inventor: Robert H. Howe, 1125 Foxwood Pl., Bend, Oreg. 97701

[21] Appl. No.: 09/024,076

[22] Filed: Feb. 17, 1998

[51] Int. Cl.[7] ..... A47G 9/08

[52] U.S. Cl. ..... 5/413 R; 5/494; 2/69.5

[58] Field of Search ..... 5/413 R, 413 AM, 5/494; 2/69.5

[56] References Cited

U.S. PATENT DOCUMENTS

| | | | |
|---|---|---|---|
| 1,281,693 | 10/1918 | Stonebridge . | |
| 1,583,419 | 5/1926 | Perl . | |
| 2,350,410 | 9/1944 | Matthesius | 5/343 |
| 2,701,885 | 2/1955 | Turco | 5/334 |
| 3,750,402 | 8/1973 | Merikallio | 5/343 |
| 3,857,125 | 12/1974 | Hunt | 5/343 |
| 4,484,362 | 11/1984 | Asher | 2/69 |
| 4,587,682 | 5/1986 | Schultz | 5/413 |
| 4,787,105 | 11/1988 | Phillips et al. | 5/413 R |
| 4,884,303 | 12/1989 | Scherer | 5/413 R |
| 4,888,828 | 12/1989 | Tatsuno | 2/69.5 |
| 4,894,878 | 1/1990 | Roach | 5/413 |
| 5,062,168 | 11/1991 | Kocib | 5/413 |
| 5,473,779 | 12/1995 | Kramer | 2/69.5 |

FOREIGN PATENT DOCUMENTS

| | | | |
|---|---|---|---|
| 377383A | 7/1990 | European Pat. Off. | 2/69.5 |

OTHER PUBLICATIONS

Demini Sports of Amsterdam, Holland: Sleeping bag with drawcords that encircle user, sold since 1970's.

*Primary Examiner*—Michael F. Trettel
*Attorney, Agent, or Firm*—David Pressman

[57] ABSTRACT

A sleeping bag (11) design for providing adjustability of the inner volume and outer exposed surface area of the bag comprises sheathed drawcords (14), preferably elastic, attached only to the top or upper portion of the bag and secured by cord locks (16) A user of the bag can tighten the drawcords during cold weather, thereby providing a warmer bag by reducing the inner volume and the exposed outer surface area of the bag without reducing the thermal protection provided to the lower portion of the bag by an underlying flat insulated pad, as would be the case with drawcords fully encircling the bag. During warmer weather, the user can relax the drawcord adjustment, thereby providing the user with more freedom of movement. Thus a considerably more versatile sleeping bag is provided—that can be adjusted to provide more warmth during cold weather or more freedom of movement during warmer weather.

20 Claims, 2 Drawing Sheets

ADJUSTABLE SLEEPING BAG WITH DRAWCORDS

BACKGROUND—FIELD OF INVENTION

This invention relates to sleeping bags, specifically to insulated sleeping bags having means that allow users to adjust the insulating ability and internal volume of the bags.

BACKGROUND—PRIOR ART

Sleeping bags can be uncomfortable, and when they're uncomfortable, they can deny their users much-needed rest. Sleeping bag comfort is largely a matter of warmth—that is, providing the bag's user with the correct amount of insulation to suit the existing conditions—and a matter of providing the user with adequate freedom of movement. These two aspects of sleeping bag comfort can work against each other. For similarly shaped bags, the more room there is inside a bag, the more freedom of movement its user has. However, the more room inside a bag, the more air space the user's body is required to heat and the more outer bag surface is exposed to the cold. Most sleeping bags provide comfort in only a rather narrow range of temperatures. So, sleeping bag manufacturers have long sought means of effectively adjusting the suitability of sleeping bags to fit a wider range of temperatures.

Both U.S. Pat. No. 2,350,410 to Matthesius (1944) and U.S. Pat. No. 1,583,419 to Perl (1926) show sleeping wraps for infants. These bags have side cords which are tied around the upper portion of each of the wraps after an infant is placed on top of the wrap and the flat sides of the wrap are folded around the infant. With both of these wraps the cords are primarily to allow one to complete closure of the wraps. Therefore, they should not be considered sleeping bags but rather, what they clearly are—sleeping wraps for infants. Perl states, "the straps 15 will serve to prevent the possible moving and kicking of the infant from dislodging the cover portion."

Both wraps are flat, it is presumed, because it is easier and safer to lay a sometimes struggling, usually writhing infant on a flat surface and fold and tie the sides around the infant than it is to insert the infant into a bag. While the cords of these two wraps may be drawn more or less tightly about the infants before tying, neither wrap is adapted for simple adjustment of its internal volume.

One method used to optimize the warmth and roominess of a sleeping bag is shown in U.S. Pat. No. 5,473,779 to Kramer (1995), where non-adjustable, permanently-attached bands of elastic material are incorporated into the portion of the bag surrounding the user's knees and legs. The object is to provide increased freedom of movement while still reducing the inner volume of the bag to optimize bag warmth. However the greater freedom of movement is provided only provided to the knees and legs. The bag cannot be adjusted to adapt it for cooler or warmer temperatures.

The lower portions of insulated sleeping bags are typically less insulated than the upper portions of the same bags because bag manufacturers rely on bag users to employ well-insulated mats under the sleeping bags. Bag manufacturers rely on such mats for good reasons—they are cheap, effective, and not as compressed by the weight of the user as is the insulation contained in the lower portion of a sleeping bag. If a good insulating mat is not placed under a sleeping bag, it is likely that more warmth will be lost to the ground by conduction than will be lost by convection to the air above the sleeper.

However even if a good ground pad is used with the bag shown in U.S. Pat. No. 4,888,828 to Tatsuno (1989), its effectiveness will be reduced. This is because Tatsuno uses non-adjustable elastic members that are permanently sewn into the bag in circumferential rings spaced axially along the bag. These rings totally encircle the bag and the bag's user and this presents a problem. By totally encircling the bag, each elasticized member pulls an area of the lower portion of the bag up and away from the underlying insulated pad. Thus, these areas are no longer insulated by full contact with the underlying insulating mat as they would otherwise be, but are instead exposed to cold air.

Roach, in U.S. Pat. No. 4,894,878 (1990) shows a bag with a liner whose circumferential dimension can be reduced by a zipper to create increased overlap of the bag's insulating batts and hence more insulation. However, it is difficult to reach an inside zipper to make the necessary adjustment.

Hunt, in U.S. Pat. No. 3,857,125 (1974) shows an insulated bag with inner and outer shell layers that are differentially cut, except in a small portion of the bag, that provides more freedom of movement for the user's shoulders. This differential cut, Hunt claims, minimizes compression of the insulation when body pressures are exerted against the outer shell. Hunt also claims that the inner shell provides self-adjusting inward lofting of the insulation in the shoulder and chin areas. Hunt's bag provides a hood that surrounds the user's face. Hunt positions the adjustable end of a drawcord used to tighten this hood at one side of the user's face and sews the drawcord to the bag at the other side of the user's face. This, it is claimed, allows the user to independently adjust the tightness of that part of the hood that is above the face. While the effectiveness of providing separate adjustability in areas that are so close together is debatable, one thing is certain: Hunt's bag in no way addresses the need for a bag with adjustability in the fit of the upper insulation.

Demini Sports, of Amsterdam, Holland has sold a sleeping bag since the early 1970s with drawcords which encircle the bag at spaced locations along the bag. However these bags suffer from the same defect Tatsuno's, above. I.e., since the means for compressing the bag completely encircle it, they draw the lower portion of the bag away from the underlying insulating ground pad, which, as stated, users normally provide under this type of bag.

In conclusion, insofar as I am aware, no sleeping bag formerly developed provides volume adjustability to a user without the defect of drawing the lower portion of the bag away from the underlying insulating ground pad.

OBJECTS AND ADVANTAGES

Accordingly several objects and advantages of the invention are to provide an improved sleeping bag, to provide means of increasing the warmth of a sleeping bag during cooler weather, to provide a bag with increased freedom of movement during warmer weather, and to provide a more user-friendly, yet economical sleeping bag. Still further objects and advantages will become apparent from a study of the following description and the accompanying drawings.

DRAWINGS

REFERENCE NUMERALS

Figure 1:
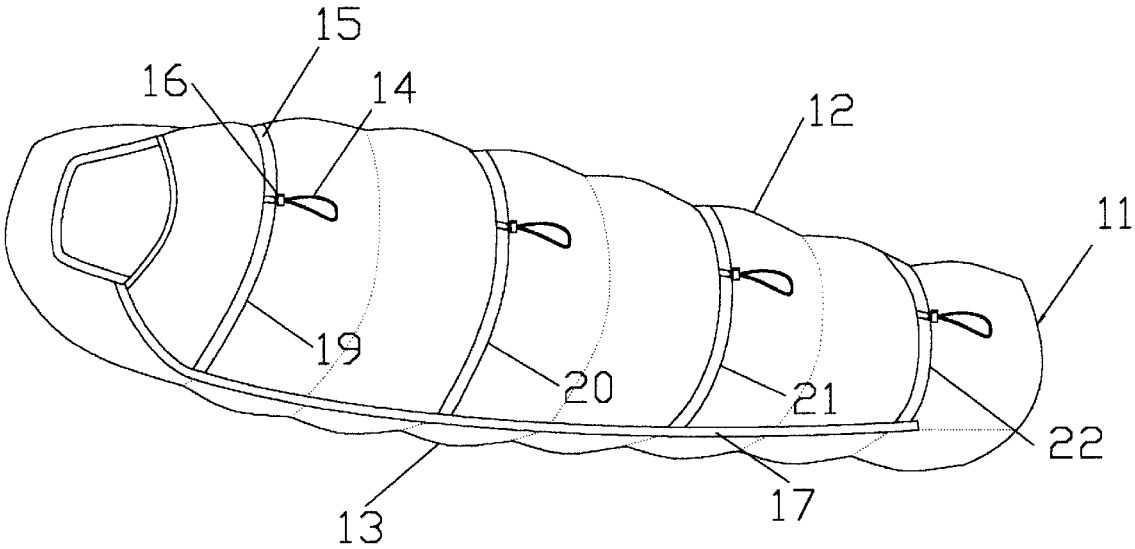
FIG. 1 is a perspective right-side view of a sleeping bag constructed in accordance with the invention, showing the upper half of the bag.

11 sleeping bag
12 upper portion of sleeping bag
13 lower portion of sleeping bag
14 drawcord
15 fabric casing sleeve
16 cord lock
17 zipper
18 side seam
19 sleeve location
20 sleeve location
21 sleeve location
22 sleeve location
23 insulation
24 inner lining fabric
25 outer shell fabric
26 occupant
27 insulating pad

SUMMARY

In accordance with the invention, an improved sleeping bag has adjustable drawcords attached to the outer shell fabric. These drawcords extend only over the top portion of the bag. Cord locks are provided to tighten the drawcords to any desired degree of warmth. The drawcords are encased in drawcord sheaths extending only across the upper portion of the bag. This allows a user to reduce the inner air space of the bag without reducing the effectiveness of the insulation of the lower portion of the bag and without the discomfort of inner encircling drawcords.

DESCRIPTION—FIG. 1—RIGHT PERSPECTIVE VIEW

FIG. 1 is a perspective view taken from the user's right side of a sleeping bag 11 constructed in accordance with the invention. An upper portion 12 of the bag has a drawcord 14, circumferentially mounted within a fabric casing sleeve 15, and secured by cord lock 16. Such cord arrangements are repeated at each of locations 19, 20, 21, and 22. Each sleeve 15 and each contained drawcord 14 extends only across the upper portion of the bag, from a zipper 17 on the right side of the bag, to a corresponding location 18 (FIG. 2) on the left side. The bottom portion of the bag (not shown) has no drawcords. The drawcords are made of stretchable elastic or non-stretchable material (nylon), while the sleeves are preferably made of the same material as the bag's outer shell, e.g., nylon or rayon. Such sleeves may be sewed, glued, or thermally bonded to the outside of the outer shell.

DESCRIPTION—FIG. 2—LEFT PERSPECTIVE VIEW

Figure 2:
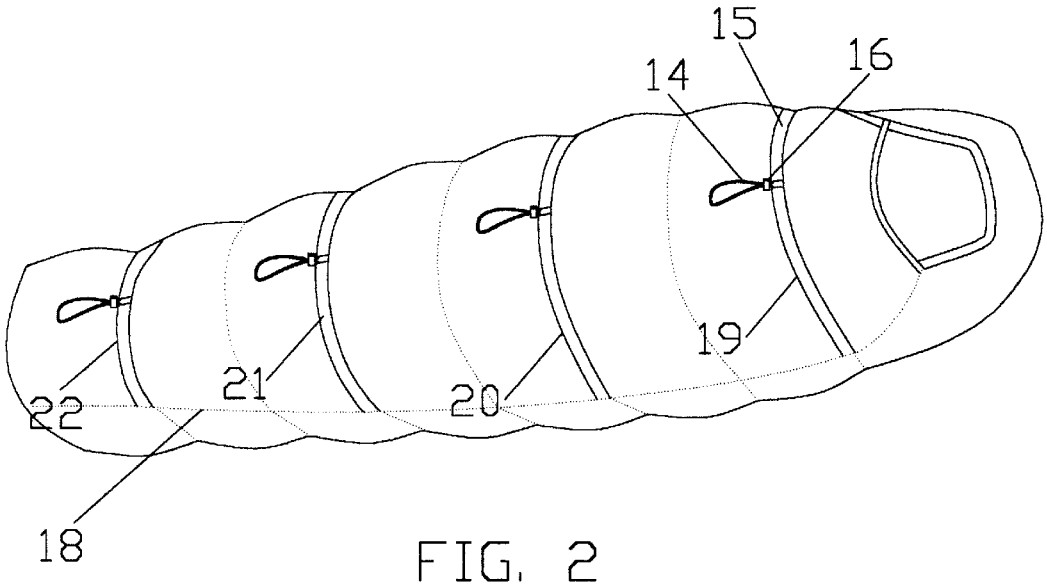
FIG. 2 is a perspective left-side view of the sleeping bag of FIG. 1.

FIG. 2 is a left perspective view of the bag, showing left side seam 18 and showing drawcord 14 mounted within sleeve 15 and secured by cord lock 16 at locations 19, 20, 21, and 22. Note that each sleeve 15 and its contained drawcord extends only over the top portion of the bag, from seam 18 to zipper 17.

DESCRIPTION—FIG. 3—CROSS SECTION—DRAWCORD LOOSE

Figure 3:
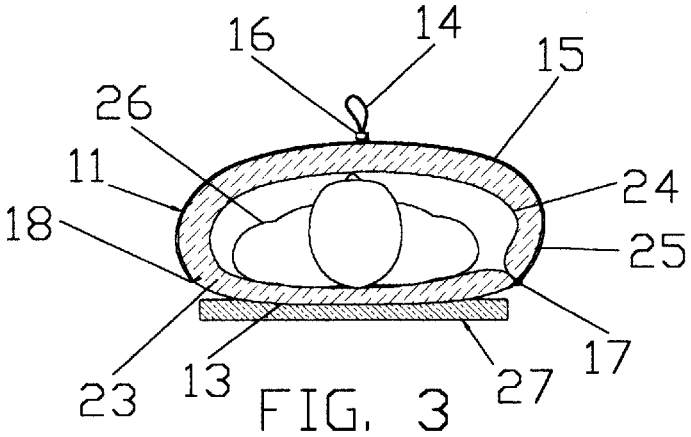
FIG. 3 is a lateral cross-sectional view of the sleeping bag of FIGS. 1 and 2 with the drawcord relaxed.

FIG. 3 is a lateral cross-section through bag 11 at location 19 showing zipper 17, side seam 18, and drawcord 14 relaxed and secured by cord lock 16 while mounted within fabric casing sleeve 15. Sleeve 15 is sewn to outer shell fabric 25. Inner lining fabric 24 and insulation 23 are not compressed since drawcord 14 is relaxed. An occupant 26 of the bag is shown in a horizontal position; note that the bag fits loosely around the occupant and that there is a lot of air space between occupant 26 and the bag. A conventional underlying insulating pad or mat 27, e.g., of foam is used under the bag.

DESCRIPTION—FIG. 4—CROSS SECTION—DRAWCORD TIGHTENED

Figure 4:
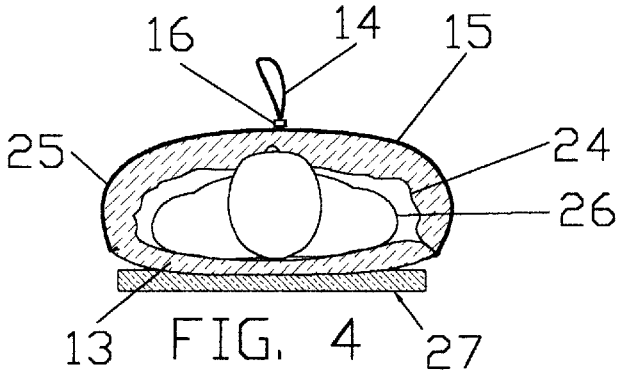
FIG. 4 is a lateral cross-sectional view of the sleeping bag of FIGS. 1 and 2 with the drawcord tightened.
Figure 5:
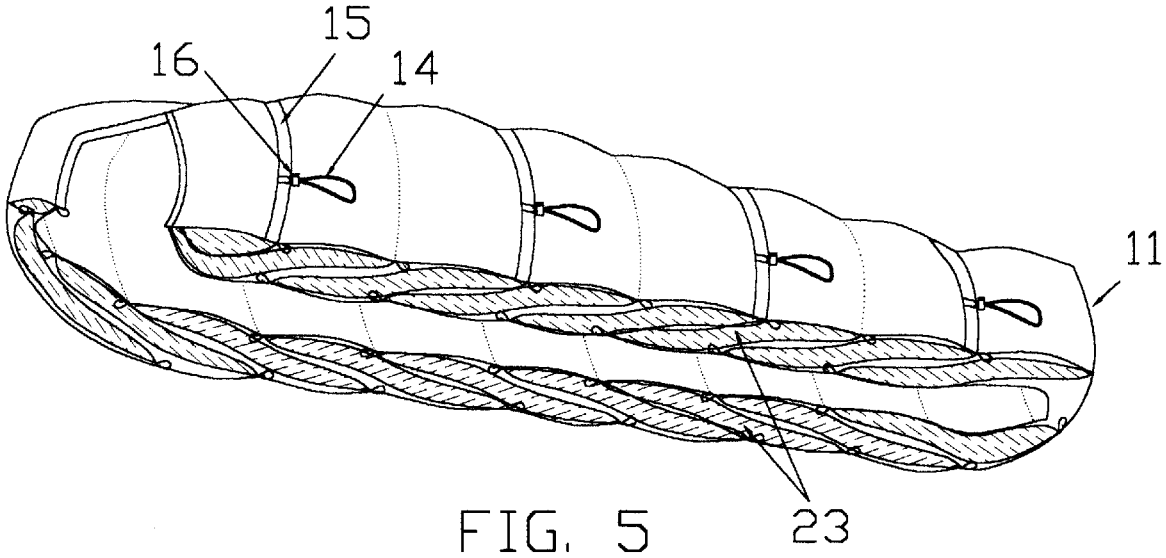
FIG. 5 is a perspective view of the bag taken from above, showing its insulation.

FIG. 4 is a lateral cross-section through sleeping bag 11 at location 19 with drawcord 14 tightened and secured by cord lock 16. Inner lining fabric 24 and insulation 23 are gathered together where they are surrounded by tightened drawcord 14. Note that the bag now fits relatively closely or tightly around occupant 26 and that there is very little air space left between occupant 26 and the bag. Insulating pad 27 is again shown under the bag.

OPERATION

In operation one uses the bag in a normal manner with insulating pad 27 under the bag. The user can, when desired, increase the warmth of the bag by tightening the drawcords and securing them with cord lock 16 (FIGS. 3 and 4). When the drawcords are tightened, five effects increase the bag's warmth:

(1) Insulating layer 23 and the inner lining fabric 24 surrounding occupant 26 become thicker.

(2) This increase in thickness also makes the bag less susceptible to the user narrowing the insulation by body movement, e.g., by poking the insulation with an elbow.

(3) The surface area of outer shell fabric 25 exposed to cold air is reduced.

(4) Since the drawcord extends only over upper portion 12 of the bag, lower portion 13 does not tend to be raised from pad 27 beneath the bag to be exposed to cold air.

(5) The air space between occupant 26 and the bag is reduced.

When the user wishes to increase the inner volume of the bag to provide greater freedom of movement (at some loss of insulating ability), it is only necessary to relax the drawcords (FIG. 3) and allow the bag to expand.

CONCLUSIONS, RAMIFICATIONS, AND SCOPE

The reader will see that I have provided an improved sleeping bag that can be produced economically, with greater versatility and increased comfort for both cooler and warmer weather. The same sleeping bag can be used in a greater variety of conditions, without the need to carry supplemental insulation. Increased warmth may be provided when desired in the upper portion of the bag without sacrificing warmth in the lower portion of the bag.

While the above description contains many specificities, these should not be construed as limitations on the scope of the invention, but as exemplifications of the presently preferred embodiments thereof. Many other ramifications and variations are possible within the teachings of the invention. For example, the number, shape, and dimensions of the cord lock sheaths may be changed, as may their orientations and locations on the outer shell fabric of the upper portion of the bag. Such sheaths can also be placed inside the bag, or between the bag's outer shell and the lining inside such shell. Hook-and-loop clamping means may be used. A system of grommets can replace the sheaths partially or altogether. One or more long, continuous drawcords can be used, each with or without multiple cord locks in different locations. Straps can replace the drawcords and various quick-release buckles can provide clamping and adjustment. The bag can be made of any suitable material, as can the drawcords and their sleeves. Each sleeve can be formed from two layers of outer fabric with parallel sewn seams. The cord locks can be at the side of the bag, rather than in the center.

Thus the scope of the invention should be determined by the appended claims and their legal equivalents, and not by the examples given.

I claim:

1. In a sleeping bag, comprising:

an upper portion which will overlie the body of an occupant when said occupant is in a horizontal position in said sleeping bag, and a lower portion which underlies the body of said occupant, said lower and upper portions being joined at opposite sides of said sleeping bag, at least one drawcord attached to said upper portion of said sleeping bag, said drawcord not extending onto said lower portion of said sleeping bag, said drawcord having two ends which are attached to said respective opposite sides of said sleeping bag, whereby (a) during cold weather, a occupant of said sleeping bag can tighten and clamp said drawcord so that the inner volume and the exposed outer surface area of said sleeping bag can be reduced in order to better insulate said occupant, (b) contact between said lower portion and any underlying flat insulated pad will not be reduced when said drawcord is tightened, and (c) said occupant of said sleeping bag can relax the tension on said drawcord during warmer conditions and thereby increase the volume of air within said sleeping bag adjacent said occupant of said sleeping bag in order to give said occupant more freedom of movement.

2. The sleeping bag of claim 1 wherein said sleeping bag has an inner lining fabric, an outer shell fabric, and an insulating layer between said inner lining fabric and said outer shell fabric.

3. The sleeping bag of claim 1 wherein said drawcord is elastic.

4. The sleeping bag of claim 1, further including a sleeve encasing said drawcord.

5. The sleeping bag of claim 4 wherein said sleeve comprises a fabric casing attached to said outer shell fabric.

6. The sleeping bag of claim 1, further including clamping means for clamping said drawcord to any selected length after adjustment.

7. The sleeping bag of claim 6 wherein said clamping means comprises a cord lock attached to said drawcord.

8. The sleeping bag of claim 7 wherein said cord lock is located proximate the center of said upper portion of said sleeping bag.

9. The sleeping bag of claim 7 wherein said cord lock is located proximate one side of said upper portion of said sleeping bag.

10. The sleeping bag of claim 1, further including a plurality of drawcords attached at spaced locations along said bag.

11. The sleeping bag of claim 10, further including a single side closure.

12. The sleeping bag of claim 10, further including an inner lining fabric, an outer shell fabric, and an insulating layer in between said inner lining fabric and said outer shell fabric.

13. The sleeping bag of claim 10 wherein said drawcord is elastic.

14. The sleeping bag of claim 10, further including a plurality of respective sleeves encasing said drawcords.

15. The sleeping bag of claim 14 wherein said sleeves each comprise a fabric casing attached to said outer shell fabric.

16. The sleeping bag of claim 10, further comprising clamping means for clamping said drawcords to any selected length after adjustment.

17. The sleeping bag of claim 16 wherein said clamping means are located proximate the center of said upper portion of said sleeping bag.

18. The sleeping bag of claim 16 wherein each of said clamping means comprises a cord lock attached to a respective drawcord.

19. A sleeping bag, comprising:

an elongated, insulated, and flexible enclosure for containing a occupant's body when said occupant is in a horizontal position in said enclosure, said enclosure comprising an upper portion which overlies the body of said occupant and a lower portion which underlies said body of said occupant, a plurality of drawcords spaced along the length of said enclosure, each of said drawcords being positioned so that when it is tightened, it will compress and reduce the area of said upper portion, but not said lower portion, of said enclosure, whereby (a) during cold weather, said occupant can tighten and clamp said drawcords so that the inner volume and the exposed outer surface area of said sleeping bag can be reduced in order to better insulate said occupant, (b) contact between said lower portion of said sleeping bag and any underlying insulated mat will not be reduced when said drawcords are tightened, and (c) said occupant can relax said drawcords during warmer conditions and thereby increase the volume of air within said sleeping bag adjacent said occupant in order to provide said occupant with more freedom of movement.

20. A method of adjusting a sleeping bag for colder and warmer weather, comprising:

providing an elongated, insulated, and flexible sleeping bag for containing a occupant's body when said occupant is in a horizontal position in said sleeping bag, said sleeping bag comprising an upper portion which overlies the body of said occupant and a lower portion which underlies said body of said occupant, during colder weather compacting and tightening at least a part of said upper portion of said sleeping bag, but not said lower portion, so that (a) the inner volume and the exposed outer surface area of said sleeping bag can be reduced in order to better insulate said occupant, yet (b) contact between said lower portion of said sleeping bag and any underlying flat insulated pad will not be reduced, and during warmer weather expanding and loosening at least a part of said upper portion of said sleeping bag, but not said lower portion, so that the inner volume and the exposed outer surface area of said sleeping bag can be increased in order to increase the volume of air within said sleeping bag adjacent said occupant of said sleeping bag in order to give said occupant more freedom of movement, said compacting and tightening being performed by tightening a drawcord attached to said upper portion of said sleeping bag, said drawcord not extending onto said lower portion of said sleeping bag, said drawcord having two ends which are attached to said respective opposite sides of said sleeping bag, and wherein said expanding and loosening is performed by loosening said drawcord.

* * * * *